US007516105B2

(12) United States Patent
Ryan, Jr. et al.

(10) Patent No.: US 7,516,105 B2
(45) Date of Patent: Apr. 7, 2009

(54) METHOD AND SYSTEM FOR INCREASING MAILING MACHINE THROUGHPUT BY PRECOMPUTING INDICIA

(75) Inventors: Frederick W. Ryan, Jr., Oxford, CT (US); Douglas A. Clark, Wallingford, CT (US); Michael J. Ramadei, Trumbull, CT (US); G. Thomas Athens, Derby, CT (US); David G. Collings, Shelton, CT (US)

(73) Assignee: Pitney Bowes Inc., Stamford, CT (US)

( * ) Notice: Subject to any disclaimer, the term of this patent is extended or adjusted under 35 U.S.C. 154(b) by 916 days.

(21) Appl. No.: 10/732,939

(22) Filed: Dec. 11, 2003

(65) Prior Publication Data

US 2005/0131844 A1 Jun. 16, 2005

(51) Int. Cl.
*G07B 17/02* (2006.01)

(52) U.S. Cl. ..... 705/401

(58) Field of Classification Search ..... 705/400
See application file for complete search history.

(56) References Cited

U.S. PATENT DOCUMENTS 5,457,642 A * 10/1995 Brookner ..... 177/25.15
5,655,023 A 8/1997 Cordery et al.
5,987,441 A * 11/1999 Lee et al. ..... 705/401
6,004,048 A * 12/1999 Moh et al. ..... 400/70
6,026,385 A * 2/2000 Harvey et al. ..... 705/408
6,154,734 A * 11/2000 Bailey et al. ..... 705/410
6,260,028 B1 * 7/2001 Lee et al. ..... 705/401
6,595,412 B2 7/2003 Manduley
2002/0046183 A1 * 4/2002 Gilham ..... 705/60
2002/0083018 A1 * 6/2002 Carroll et al. ..... 705/401
2003/0177104 A1 * 9/2003 Athens et al. ..... 705/401

OTHER PUBLICATIONS

Tygar, et al., "Cryptographic Postage Indicia" (Jan. 1996), CMU-CS-96-113.*

* cited by examiner

*Primary Examiner*—John W Hayes
*Assistant Examiner*—Rob Wu
(74) *Attorney, Agent, or Firm*—Brian A. Lemm; Angelo N. Chaclas

(57) ABSTRACT

A method and system that increases the throughput of a mailing machine by continuously computing indicia prior to and during mail processing is provided. The indicia generation process is divided into two distinct parts, cryptographic calculation and funds committal/printing. Indicium data are continuously computed, asynchronously with the printing of the indicia, and stored in a buffer until needed. This enables several indicium data to be computed and stored prior to processing of a mail piece by the mailing machine. Prior to printing an indicium on a mail piece, the funds for the indicium are accounted for by updating the registers of the mailing machine. Since a number of indicium data may be precomputed prior to the start of processing the mail through the mailing machine, the throughput of the mailing machine can be increased.

34 Claims, 7 Drawing Sheets

28

| BUFFER | REGISTER VALUES ASSOCIATED WITH INDICIUM DATA | | |
|---|---|---|---|
| | PIECE COUNT X | ASCENDING REGISTER Y | DESCENDING REGISTER Z |
| INDICIUM DATA 1 | X+1 | Y + (AMOUNT) | Z - (AMOUNT) |
| INDICIUM DATA 2 | X+2 | Y + 2(AMOUNT) | Z - 2(AMOUNT) |
| INDICIUM DATA 3 | X+3 | Y + 3(AMOUNT) | Z - 3(AMOUNT) |
| | | | |
| | | | |
| | | | |
| INDICIUM DATA N-1 | X+(N-1) | Y + (N-1)(AMOUNT) | Z - (N-1)(AMOUNT) |
| INDICIUM DATA N | X+N | Y + N(AMOUNT) | Z - N(AMOUNT) |

FIG. 5

METHOD AND SYSTEM FOR INCREASING MAILING MACHINE THROUGHPUT BY PRECOMPUTING INDICIA

FIELD OF THE INVENTION

The invention disclosed herein relates generally to mailing machines, and more particularly to a method and system for increasing the throughput of a mailing machine.

BACKGROUND OF THE INVENTION

Mailing machines for printing postage indicia on envelopes and other forms of mail pieces have long been well known and have enjoyed considerable commercial success. There are many different types of mailing machines, ranging from relatively small units that handle only one mail piece at a time, to large, multi-functional units that can process hundreds of mail pieces per hour in a continuous stream operation. The larger mailing machines often include different modules that automate the processes of producing mail pieces, each of which performs a different task on the mail piece. The mail piece is conveyed downstream utilizing a transport mechanism, such as rollers or a belt, to each of the modules. Such modules could include, for example, a singulating module, i.e., separating a stack of mail pieces such that the mail pieces are conveyed one at a time along the transport path, a moistening/sealing module, i.e., wetting and closing the glued flap of an envelope, a weighing module, and a metering module, i.e., applying evidence of postage to the mail piece. The exact configuration of the mailing machine is, of course, particular to the needs of the user.

Typically, a control device, such as, for example, a microprocessor, performs user interface and controller functions for the mailing machine. Specifically, the control device provides all user interfaces, executes control of the mailing machine and print operations, calculates postage for debit based upon rate tables, provides the conduit for the Postal Security Device (PSD) to transfer postage indicia to the printer, operates with peripherals for accounting, printing and weighing, and conducts communications with a data center for postage funds refill, software download, rates download, and market-oriented data capture. The control device, in conjunction with an embedded PSD, constitutes the system meter that satisfies U.S. information-based indicia postage (IBIP) meter requirements and other international postal regulations regarding closed system meters. The United States Postal Service (USPS) initiated the Information-Based Indicia Program (IBIP) to enhance the security of postage metering by supporting new methods of applying postage to mail. The USPS has published draft specifications for the IBIP. The requirements for a closed system are defined in the "Performance Criteria for Information-Based Indicia and Security Architecture for Closed IBI Postage Metering System (PCIBI-C), dated Jan. 12, 1999. A closed system is a system whose basic components are dedicated to the production of information-based indicia and related functions, similar to an existing, traditional postage meter. A closed system, which may be a proprietary device used alone or in conjunction with other closely related, specialized equipment, includes the indicia print mechanism.

The PCIBI-C specification defines the requirements for the indicium to be applied to mail produced by closed systems. The indicium consists of a two-dimensional (2D) barcode and certain human-readable information. Some of the data included in the barcode includes, for example, the PSD manufacturer identification, PSD model identification, PSD serial number, values for the ascending and descending registers of the PSD, postage amount, and date of mailing. In addition, a digital signature is required to be created by the PSD for each mail piece and placed in the digital signature field of the barcode. Several types of digital signature algorithms are supported by the IBIP, including, for example, the Digital Signature Algorithm (DSA), the Rivest Shamir Adleman (RSA) Algorithm, and the Elliptic Curve Digital Signature Algorithm (ECDSA).

Thus, for each mail piece the PSD must generate the indicium, including computing the digital signature to be included in the indicium, once the relevant data needed for the indicium generation are passed into the PSD. The generated indicium can then be printed on a mail piece. Typically, to reduce the risk of lost funds, the debiting of the postage value for the generated indicium is delayed until just before the printing of the indicium begins. In this manner, if the mail piece does not reach the printing area, such as, for example, due to a jam or other malfunction, and the indicium is not printed, there are no funds deducted for the indicium that is not printed. Thus, the debit operation is preferably not performed until the mail piece on which the indicium is to be printed has passed a "point of no return," thereby providing some assurance that printing of the indicium will occur.

FIG. 1 illustrates a timing diagram for a conventional mailing machine used to print indicia on mailing machines. As illustrated, the timing includes a succession of cryptographic processing intervals and printing intervals. The cryptographic processing for a first mail piece (Mailpiece #1) begins when the amount of desired postage is entered by an operator (Set Postage). Printing of the first mail piece, and debiting for the funds included in the indicium, occur when the first mail piece reaches the printing area (First Mailpiece Present). Thus, as illustrated, there may be some delay (idle time) between the time the cryptographic processing for the first mail piece has been completed and the printing begins. This delay is typically due to the amount of time it may take for the operator to place the mail piece (or stack of mail pieces if processing a batch) into the input of the mailing machine and/or the time required to transport the mail piece from the input of the mailing machine to the printing area. In the processing illustrated by FIG. 1, the cryptographic processing for an indicium for the next mail piece (Mailpiece #2) does not begin until printing of the indicium on the current mail piece (Mailpiece #1) has been completed. Since the generation of the indicium, including computation of the digital signature, requires a predetermined amount of time, as well as printing each indicium, the throughput of a mailing machine utilizing the timing illustrated in FIG. 1 is limited by these time constraints. Specifically, the number of mail pieces that the mailing machine can process per hour is constrained by the total cycle time for each mail piece, i.e., the amount of time required to generate and print an indicium.

The throughput of mailing machines has been improved by implementing the processing in a pipelined fashion as illustrated in FIG. 2. As shown in FIG. 2, the cryptographic processing for the first mail piece (Mailpiece #1) is similar as that described with respect to FIG. 1 above; however, the cryptographic processing for the next mail piece (Mailpiece #2) begins after the debit operation is performed for the first mail piece (Mailpiece #1) and while the first mail piece is being printed with the indicium just generated. Thus, as compared with the processing as illustrated in FIG. 1, the number of mail pieces that can be processed in the same amount of time is increased, thereby increasing the throughput of the mailing machine.

There are, however, still some limitations with the processing as illustrated in FIG. 2. The throughput of the mailing machine is directly proportional to the most time consuming of the steps involved, i.e., the time delay required for the cryptographic processing. For smaller mailing machines that do not have high throughput, the time delay associated with such generation and computation does not limit the throughput, i.e., the calculations are performed quickly enough and therefore are not a limiting factor for the throughput. For larger mailing machines with higher throughputs, however, the speed of cryptographic processing may be the limiting factor with respect to the throughput of the mailing machine. Several methods have been devised to increase the throughput of mailing machines constrained by the speed of cryptographic processing. One such method includes performing parts of the cryptographic operation not dependent upon actual characteristics of the mail piece prior to knowing those characteristics, e.g., calculating the r value in a Digital Signature Algorithm (DSA) indicium. Another method includes pre-computing large numbers of indicia, including performing accounting for these indicia, of different values and storing them for future use. While both of these methods increase the throughput, there are some drawbacks. For example, performing parts of the cryptographic processing does not take advantage of all "unused" time in mail processing, i.e., time when the cryptographic processor is normally idle. Pre-computing large numbers of indicia of different values and storing them requires large amounts of memory and sophisticated bookkeeping to track the indicia that have been used.

Thus, there exists a need for a method and system that increases the throughput of a mailing machine.

SUMMARY OF THE INVENTION

The present invention alleviates the problems associated with the prior art and provides a method and system that increases the throughput of a mailing machine by continuously computing indicia prior to and during mail processing.

In accordance with the present invention, indicium data is computed asynchronously with the printing of the indicia. The indicia generation process is divided into two distinct parts, cryptographic calculation and funds committal/printing. Indicium data are continuously computed and stored in a buffer until needed. This enables several indicium data to be computed and stored prior to processing of a mail piece by the mailing machine. The indicium data is used to provide an indicium that evidences postage for a mail piece. Immediately prior to printing an indicium evidencing postage on a mail piece, the funds for the indicium are accounted for by updating the registers of the mailing machine. Since a number of indicium may be pre-computed prior to the start of processing the mail through the mailing machine, the throughput of the mailing machine can be increased.

Therefore, it should now be apparent that the invention substantially achieves all the above aspects and advantages. Additional aspects and advantages of the invention will be set forth in the description that follows, and in part will be obvious from the description, or may be learned by practice of the invention. Moreover, the aspects and advantages of the invention may be realized and obtained by means of the instrumentalities and combinations particularly pointed out in the appended claims.

DESCRIPTION OF THE DRAWINGS

The accompanying drawings illustrate a presently preferred embodiment of the invention, and together with the general description given above and the detailed description given below, serve to explain the principles of the invention. As shown throughout the drawings, like reference numerals designate like or corresponding parts.

FIG. 5 illustrates a buffer used to store indicium data generated by the cryptographic processing according to the present invention;

DETAILED DESCRIPTION OF THE PRESENT INVENTION

Figure 3:
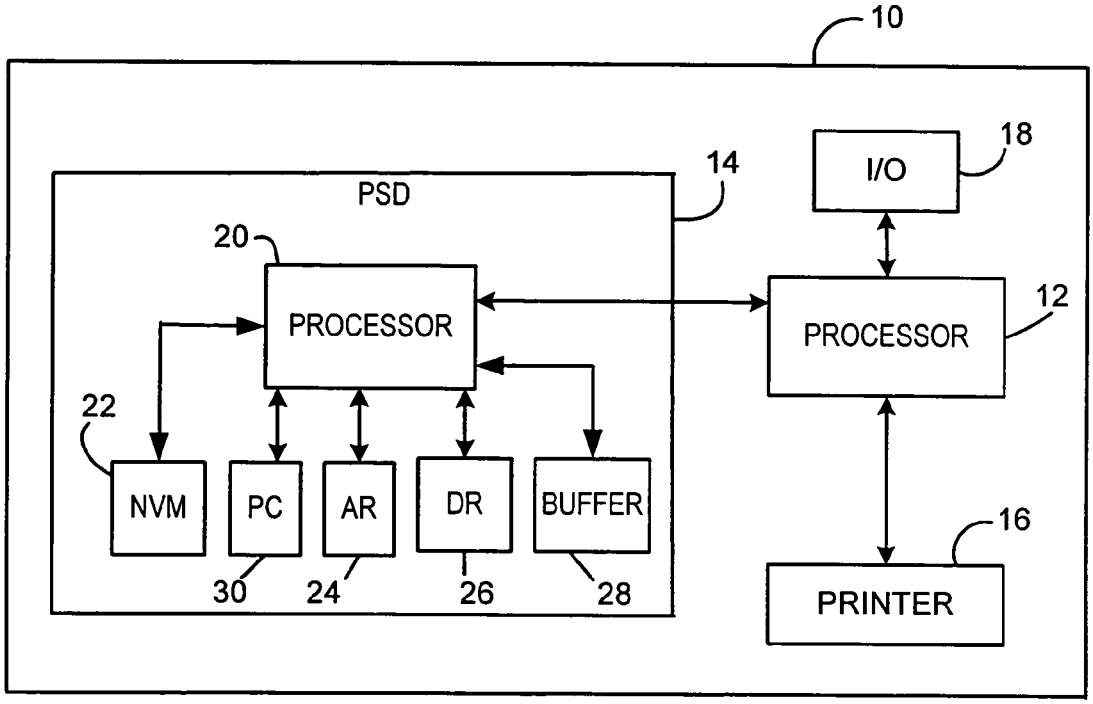
FIG. 3 illustrates in block diagram form a portion of a mailing machine that performs indicia pre-computation according to the present invention.

In describing the present invention, reference is made to the drawings, wherein there is seen in FIG. 3 a portion of a mailing machine 10 according to the present invention. Mailing machine 10 includes a printer 16 adapted to print postage indicia on a mail piece. Printer 16 is coupled to processor 12, which controls operation of the mailing machine 10. Processor 12 is coupled to one or more input/output devices 18, such as, for example, a keyboard and/or display unit for the input and output of various data and information. Processor 12 is further coupled to a PSD 14. PSD 14 generates indicium data, including a digital signature included in the indicium. PSD 14 includes a processor 20 to control operation of the PSD 14, including performing cryptographic operations necessary for generating the indicium for each mail piece and calculating the digital signature. PSD 14 also includes a non-volatile memory (NVM) 22 used to store operating algorithms, cryptographic keys, and the like necessary for operation of the PSD 14. PSD 14 further preferably includes an ascending register (AR) 24, a descending register (DR) 26, and a piece count register (PC) 30 in which critical accounting data relevant to the operation of the mailing machine 10 is stored. It should be understood that PSD 14 may also include other types of registers as well. An indicium, including the digital signature, generated by the PSD 14 is passed to the processor 12, which then passes the assembled indicium to printer 16 for printing on a mail piece. Alternatively, processor 12 could perform some of the operations related to generation of the indicium that do not require secure cryptographic processing (e.g., formatting of a 2-D barcode).

In accordance with the present invention, the mailing machine 10 further includes a buffer 28 in which pre-computed indicia, as described below, can be stored. Buffer 28 is preferably implemented as a first in, first out (FIFO) circular buffer. Preferably, the buffer 28 is located within the PSD 14 as illustrated, thereby securing the buffer 28 from tampering. Alternatively, the buffer 28 need not be located within the PSD 14. In addition, the buffer 28, regardless of where it is located, can optionally be cryptographically protected. The cryptographic algorithm used to protect the data can be a high performance algorithm, such as, for example, Data Encryption Standard (DES) or Advanced Encryption Standard (AES), which can also be implemented in hardware.

Figure 4:
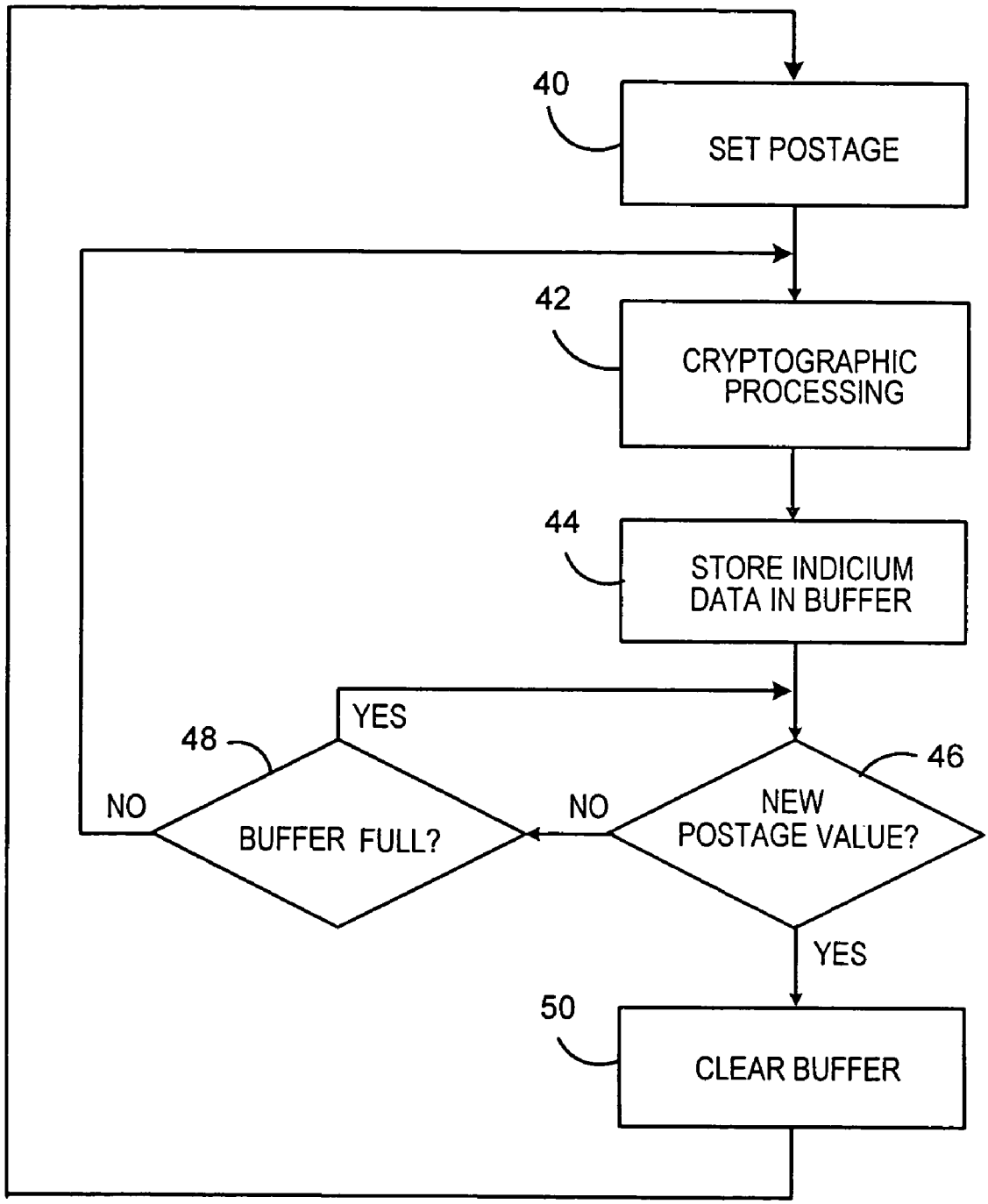
FIG. 4 illustrates in flow chart form an example of the processing of cryptographic operations according to the present invention.

In accordance with the present invention, the processing of mail pieces is divided into two distinct processes. The first process includes the cryptographic processing necessary to generate each indicium, and the second process includes accounting for the indicium and printing the indicium. These two processes are executed asynchronously to achieve maximum throughput of the mailing machine 10, especially when processing batches of mail pieces. Referring now to FIG. 4, there is illustrated in flow chart form an embodiment of the first of the two processes, i.e., the cryptographic processing performed by the mailing machine 10 according to an embodiment of the present invention. Suppose, for example, an operator desires to process a batch of similar mail pieces, i.e., the same weight and class of service. At step 40, the postage amount is set. For example, the postage amount could be entered by an operator using the I/O 18 of the mailing machine 10. For example, if the mail pieces are being sent first class and weigh one ounce or less, the operator would set the postage to $0.37. In step 42, the cryptographic processing, i.e., generation of indicium data according to the applicable postal standard, by the PSD 14 starts. The cryptographic processing by the PSD 14 begins as quickly as possible after the postage has been set in step 40, thereby taking advantage of any delay associated with the operator loading the batch of mail pieces into the mailing machine 10 or pressing a start key or entering a start command.

In step 44, the indicium data generated in step 42 is stored in the buffer 28. The indicium data could be stored as an image of the generated indicium, raw data from which the image could be generated (for example, by processor 12) or barcode data from which the image could be generated. The indicium data could include, for example, the digital signature calculated by the processor 20 of PSD 14. The digital signature is calculated utilizing values, as updated for the current indicium, from the ascending register 24 and descending register 26, and may also include a piece count from the piece count register 30. The indicium data stored in the buffer 28 can also include one or more of the register values, postage amount, date, identification of the PSD 14, or other data used in the generation of the indicium. Note, however, that although the indicium data has been generated and stored, accounting for the indicium has not yet been performed.

In step 46, processor 20 determines if a new postage value has been set. If a new postage value has not been set, then in step 48 the processor 20 determines if the buffer 28 is full. If the buffer 28 is not full, then the processor 20 returns to step 42 and performs cryptographic processing to generate another indicium data. Thus, the next indicium data will be generated even though accounting or printing for the previous indicium data has not yet been performed, and the indicium data will be continuously generated in immediate succession one after another. This next indicium data is generated, however, based on what the values of the registers would be from the previous indicium data generated and stored in the buffer 28. Thus, for example, the ascending register 24 value would be increased by $0.37, the descending register 26 value would be decreased by $0.37, and the piece count register 30 would be increased by one. If it is determined in step 48 that the buffer 28 is full, then the processor 20 returns to step 46 to determine if a new postage value has been set. Thus, once the buffer 28 is full, the process of generating indicium data based on the postage value set in step 40 is temporarily suspended until a portion of the buffer 28 becomes available as described below.

If in step 46 it is determined that a new postage value has been set, then in step 50 the buffer 28 is cleared, i.e., any indicium data stored in the buffer 28 is erased, as any indicium data stored therein will no longer be applicable as they were generated based on the previous postage value. Recall from above that accounting had not yet been performed for the indicium data stored in the buffer 28. Thus, any funds required for the indicium data stored in the buffer 28 will not be debited, as the indicium data in the buffer 28 has been erased.

As shown in FIG. 4, the cryptographic processing of indicia data, based on the postage value set in step 40, will continue until either the buffer 28 is full or a new postage value is set. Note however that the cryptographic processing by the PSD 14 begins as quickly as possible after the postage amount has been set in step 40, thereby taking advantage of any delay associated with the operator loading the batch of mail pieces into the mailing machine 10 or pressing a start key or entering a start command. Thus, if the time required for the processor 20 to perform the cryptographic processing for an indicium is 100 msec, and there is a 1 second delay between the time the postage value is set in step 40 and the mail pieces are placed into the mailing machine or a start key is pressed, the PSD 14 will be able to generate indicium data for 10 indicia and store the indicium data in the buffer 28 before mail processing begins.

FIG. 5 illustrates an example of a buffer 28 having N memory locations for storage of indicium data which is full of indicium data generated by the process illustrated in FIG. 4. The table adjacent to the buffer 28 illustrates the register values for registers 24, 26 and 30 associated with the indicium data stored in the respective locations of the buffer 28. The register values for each successive indicium data are based on the register values of the preceding indicium, even though the actual values stored in the registers 24, 26, and 30 have not been updated (as accounting has not yet occurred). Thus, suppose for example, the actual register values for the piece count register 30, ascending register 24 and descending register 26 are some values x, y and z, respectively when the processing illustrated in FIG. 4 begins. When the processor 20 performs the cryptographic processing for the first indicium, the indicium data for the first indicium (INDICIUM DATA 1) will be based on register values in which the piece count is increased by one (x+1), the ascending register value is increased by the postage amount (y+(AMOUNT)), and the descending register value is decreased by the postage amount (z−(AMOUNT)). The indicium data for the second indicium stored in the buffer 28 (INDICIUM DATA 2) will be based on register values that are changed by the same amounts as for the first indicium, but are based on the values associated with the first indicium. Thus, for the second indicium the piece count is increased by two (x+2), the ascending register value is increased by the two times the postage amount (y+2(AMOUNT)), and the descending register value is decreased by two times the postage amount (z−2(AMOUNT)). The indicium data for the last indicium stored in the buffer 28 (INDICIUM DATA N) will thus be based on register values in which the piece count is increased by N (x+N), the ascending register value is increased by the N times the postage amount (y+N(AMOUNT)), and the descending register value is decreased by N times the postage amount (z−N(AMOUNT)). As noted above, the buffer 28 is preferably implemented as a circular FIFO buffer, such that when INDICIUM DATA 1 is removed from the buffer 28, the remaining indicium data will shift upward thereby vacating the last position in the buffer 28 and new indicium data, e.g., INDICIUM DATA N+1, will be stored in the location previously occupied by the indicium data INDICIUM DATA N.

Figure 6:
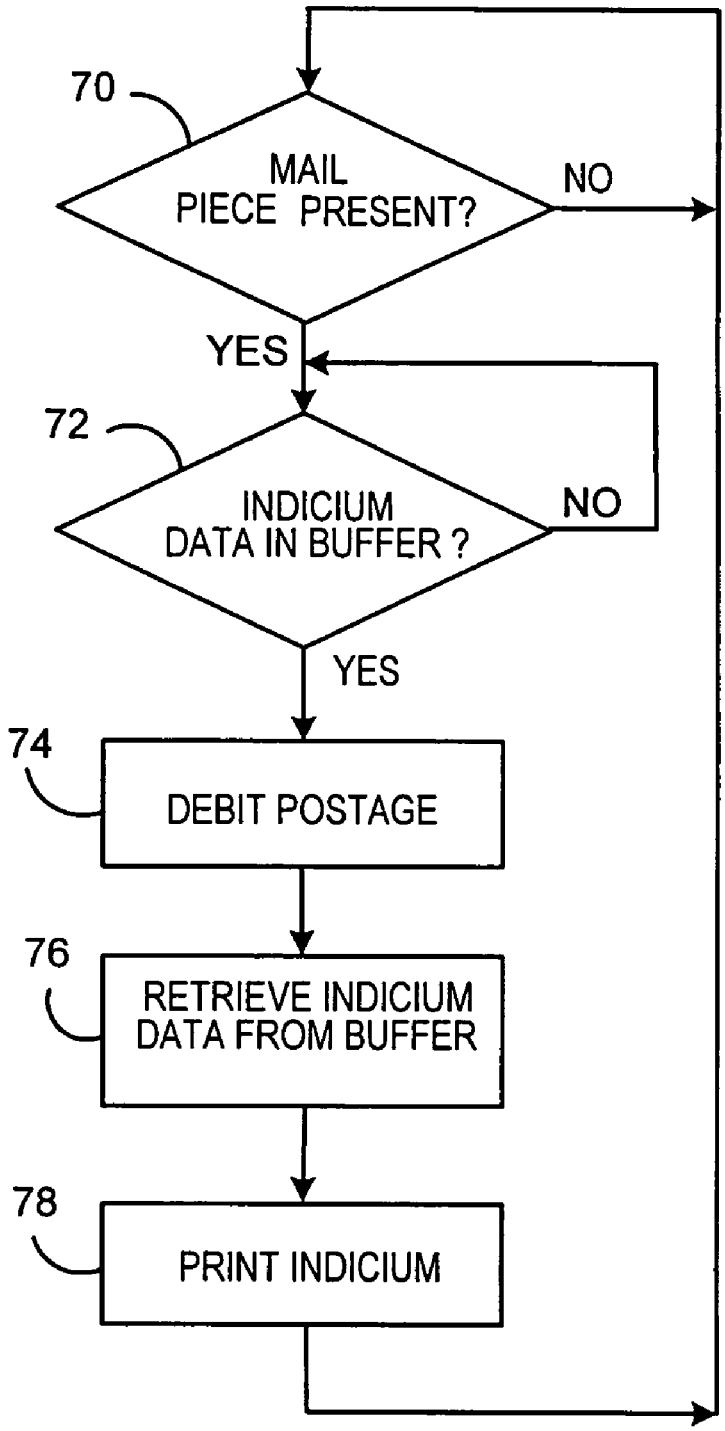
FIG. 6 illustrates in flow chart form an example of the printing and accounting processing according to the present invention.

Referring now to FIG. 6, there is illustrated in flow chart form the second of the two processes of the present invention, i.e., the accounting and printing for indicium as performed by the mailing machine 10 according to an embodiment of the present invention. The accounting and printing process as illustrated in FIG. 6 is performed asynchronously with the cryptographic processing as illustrated in FIG. 4 to achieve maximum throughput for the mailing machine 10. As shown in FIG. 6, in step 70 the mailing machine 10 determines if a mail piece is present upon which an indicium is to be printed. Such determination could be made, for example, by the mail piece passing a sensor that sends a signal to the processor 12. If no mail piece is present, the processor 12 continues to loop through step 70 until a mail piece is detected as being present. Once a mail piece has been detected in step 70, a request for an indicium data will be made, such as, for example, by processor 12, and in step 72 it is determined if there is indicium data available in the buffer 28. Such determination could be performed, for example, by processor 20. Alternatively, buffer 28 could be implemented as a dual port memory which may be accessed directly by processor 12. It should be understood that since the processing of indicium data begins as quickly as possible after the postage value has been set, and there is typically an inherent delay from the time the postage value is set until the first mail piece will be detected for printing, the response in step 72 will generally be positive, at least for a first portion of mail pieces in a batch. However, if there is a large batch being processed and the mail pieces can be processed faster than the cryptographic processing occurs, eventually the buffer 28 may be emptied and the processing of the mail pieces by mailing machine 10 may have to be slowed to allow sufficient time for new indicium data to be generated and stored in buffer 28. This is, of course, dependent upon the speed at which the processor 20 performs the cryptographic processing, the size of the buffer 28, and whether or not any non-printing time is utilized to generate new indicium data. For example, for printing systems that utilize ink jet technology, periodic maintenance of the print head nozzles, e.g., cleaning, is required. During such maintenance, the print operations are paused, thereby providing an opportunity to build the stock of indicium data stored in the buffer 28. Thus, the size of the buffer 28 can be optimized based on numerous factors, including, for example, the speed of the processor 20, the amount of time required for maintenance operations, and the typical batch size that mailing machine 10 is expected to process, thereby reducing the likelihood of indicium data not being available in the buffer 28. If in step 72 indicium data is not available in the buffer 28, then the mail piece is held until indicium data is generated (for example by the process illustrated in FIG. 4) and stored in the buffer 28.

If it is determined in step 72 that indicium data is available in the buffer 28, then in step 74 the funds for the mail piece are accounted for by debiting the postage, i.e., updating the values of the registers 24, 26, 30. In step 76, which can occur before, after or concurrently with step 74, the next available indicium data is retrieved from the buffer 28, and in step 78 the indicium is printed on the mail piece. It should be noted that printing the indicium in step 78 may involve one or more steps depending on the format in which the indicium data is stored in the buffer 28. For example, it may be necessary for the processor 12 to generate the full indicium image using the indicium data retrieved from the buffer 28. For example, if only the digital signature is stored in the buffer 28, then the digital signature will be retrieved and combined with the other information necessary to generate the full indicium for printing. If the indicium data is stored as an image of the indicium, then printing in step 78 comprises retrieving the image and printing the image. Once the indicium has been printed in step 78, the processing loops back to step 70 to determine if another mail piece is present.

Figure 7:
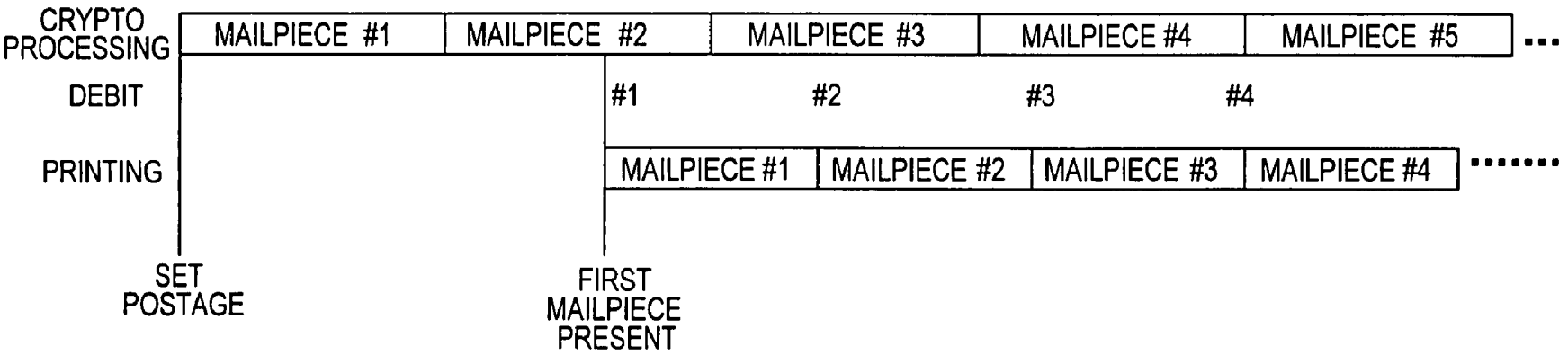
FIG. 7 illustrates a timing diagram for a mailing machine used to generate and print indicia on mail pieces according to the present invention.

Referring now to FIG. 7, there is illustrated a timing diagram for mailing machine 10 according to the present invention. As shown in FIG. 7, the cryptographic processing for a first mail piece (Mailpiece #1) begins when the amount of desired postage is entered by an operator (Set Postage), and the cryptographic processing for the next mail piece (Mailpiece #2) begins as soon as the processing for the first mail piece has been completed. Thus, the indicium data for successive indicia is created one after another without any idle time for the processor 20. The indicium data is stored in the buffer 28 as previously described. Printing of the first mail piece, and debiting for the funds included in the indicium, occur when the first mail piece reaches the printing area (First Mailpiece Present). Since, according to the present invention, the cryptographic processing for the second mail piece began as soon as the processing for the first mail piece ended, the cryptographic processing for the second mail piece will be completed before the printing of the first mail piece has been completed. Thus, as soon as the first mail piece has been printed, the printing for the second mail piece can begin without any delay. Thus, there is no idle time during the printing process. Since any idle time has been removed in the timing according to the present invention, the throughput of the mailing machine can be increased.

Figure 1:
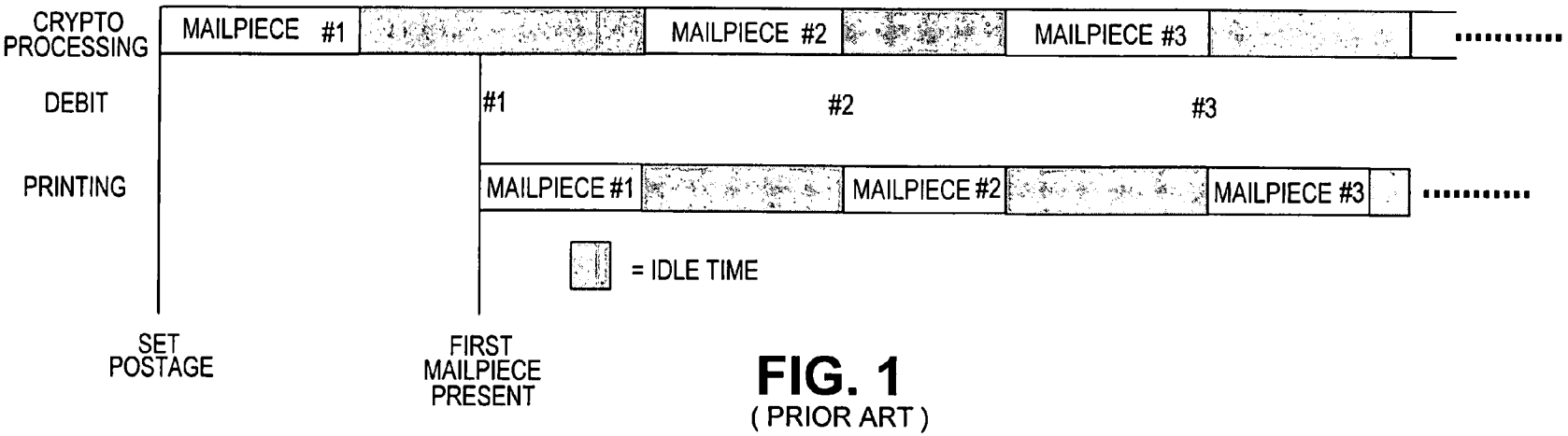
FIG. 1 ( PRIOR ART )
FIG. 1 illustrates a timing diagram for a conventional mailing machine used to print indicia on mail pieces.
Figure 2:
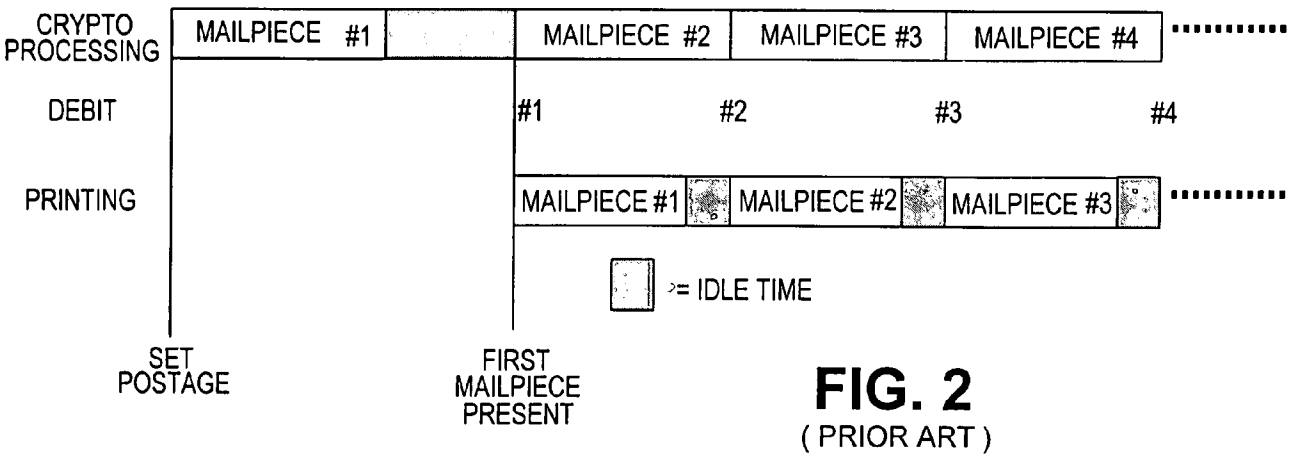
FIG. 2 ( PRIOR ART )
FIG. 2 illustrates a timing diagram for an improved conventional mailing machine used to print indicia on mail pieces.
Figure 8:
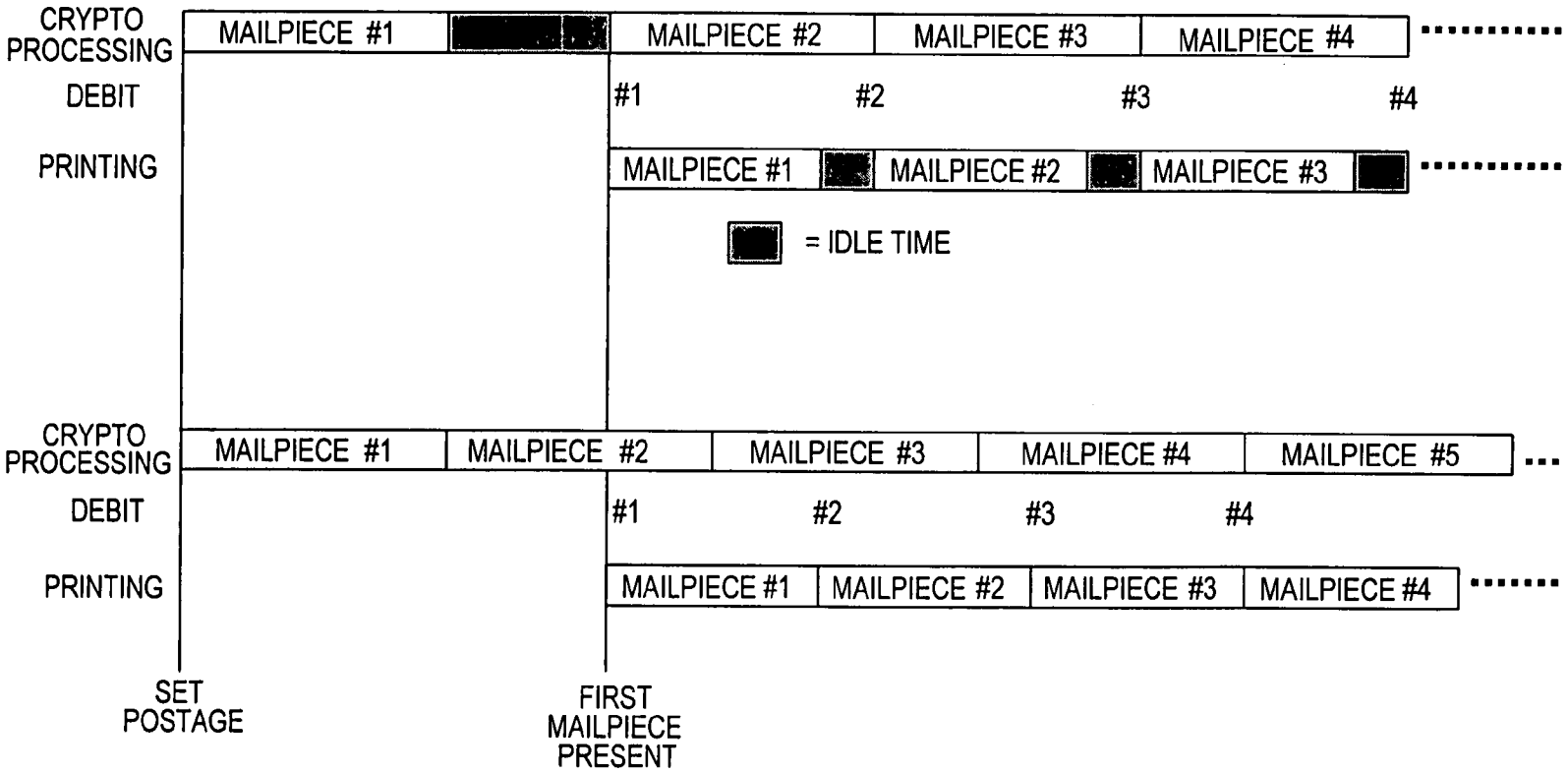
FIG. 8 illustrates a direct comparison of the timing diagrams of FIGS. 2 and 7.

FIG. 8 illustrates a direct comparison of the timing diagrams of a conventional mailing machine as illustrated in FIG. 2 and the mailing machine 10 of the present invention as illustrated in FIG. 7. As shown in FIG. 8, the processing of the present invention improves the throughput of the mailing machine 10, as the time required for the mailing machine 10 to process the same number of mail pieces as a conventional machine is decreased. For example, utilizing the processing of the present invention, the printing of a fourth mail piece (Mailpiece #4) starts at a time when the third mail piece (Mailpiece #3) is still being printed utilizing the conventional processing. As an example of the difference illustrated in FIG. 8, consider the situation where a mailing machine will be processing 100 mail pieces in a batch. The cryptographic processing required for an indicium is 100 msec, and the other processing required for the indicium, e.g., image generation, printing, etc., takes 70 msec. Further assume that there is a 1 second delay between the time the postage value is set and the mail pieces are placed in the mailing machine or a start command is received. Utilizing the conventional processing as illustrated in FIG. 2, the time, $t_C$, required to process this batch of mail is given by the following equation:

$$t_C = P^* \max(C, O)$$

where P is the number of pieces in the batch, C is the time required for cryptographic processing of a single piece, and 0 is the time required for any other processing to produce an indicium. Thus, the processing speed is limited by the cryptographic processing time, and each mail piece can be processed in no less than this time. Using the values from above, $t_C$ is calculated to be $$t_C = 100^* 100 \text{ msec} = 10 \text{ seconds.}$$

Utilizing the processing of the present invention as illustrated in FIG. 7, the average amount of time, m, required to process each mail piece in a batch can be determined by the following equation:

$$m=C-d/P$$

where P is the number of pieces in the batch, C is the time required for cryptographic processing of a single piece, and d is the delay between the time the postage value is set and the mail pieces are placed in the mailing machine or a start command is received. Using the values from above, m is calculated to be $$m=100\text{ msec}-1\text{ sec}/100=90\text{ msec.}$$

The processing time, $t_I$, for the batch of mail pieces according to the present invention can be determined by the following equation:

$$t_I=m*P.$$

Thus, to process the 100 mail pieces utilizing the present invention, the time required is calculated to be $$t_I=100*90\text{ msec}=9\text{ sec.}$$

Thus, the processing of a batch of 100 mail pieces according to the present invention would take one second less than the time required to process the same batch using the conventional methods. This represents an increase in processing speed of 10% as compared with the conventional processing.

Thus, according to the present invention, a method and system that increases the throughput of a mailing machine by continuously computing indicia prior to and during mail processing is provided. Those skilled in the art will also recognize that various modifications can be made without departing from the spirit of the present invention. For example, the postage value may be set utilizing an external scale and rate table, or an integral scale and rate table in which the mail pieces are weighed as they are being transported through the mailing machine. As another example, in cases where the cryptographic calculation may be split into several parts, e.g., DSA, only part of the calculation may be pre-computed and stored in the buffer 28. The second part of the calculation may be performed at the time the funds are debited, i.e., printing of the indicium. A digital signature is computed by completing two calculations utilizing various parameters. For example, the DSA algorithm uses the following predetermined parameters known by the PSD 14:

p=a prime number between 512 and 1024 bits in length;

q=a 160 bit prime factor of (p−1);

$g=h^{(p-1)/q}$ mod p, where h is any number less than p−1 such that $h^{(p-1)/q}$ mod p>1;

x=a number less than q (this is the private key);

$y=g^x$ mod p (this is the public key).

The 40-byte signature, comprising two portions r and s as defined below, is computed using the following additional parameters:

k=a random number less than q (determined by processor 20 of PSD 14);

m=the message to be signed; and

H(m)=the hash of the message to be signed.

The values for r and s of the signature are calculated as follows:

$$r=(g^k \bmod p)\bmod q \quad (1)$$

$$s=(k^{-1}*(H(m)+x*r))\bmod q \quad (2)$$

Because the only variables in the signature data are the random number k, which is determined by processor 20, the message m and the message hash H(m), the value of r in equation (1) above can be pre-computed and stored in the buffer 28. In accordance with an embodiment of the present invention, the indicium data can include only the partial computation of the digital signature, i.e., the value of r in equation (1) above. In addition, the values for $k^{-1}$ and $k^{-1}*x*r$ can also optionally be pre-computed and stored in the buffer 28, thus reducing the time required for calculation of the value of s in equation (2). The partial computation processing can begin as soon as the mailing machine 10 is powered, as in this embodiment it is not necessary to set the postage amount before the partial computation processing can begin. Thus, for example, the cryptographic processing in step 42 of FIG. 4 need not begin after a postage amount is set (step 40) but instead can begin as soon as possible after the mailing machine has been powered. Since the partial computation of the digital signature in this embodiment is not dependent upon the postage amount, the cryptographic processing will continue until the buffer 28 is full. When a postage amount is set, thereby completing the message portion m of the digital signature, the funds for the mail piece can be accounted for by debiting the postage (for example, in step 74 of FIG. 6), the remainder of the signature calculation can be performed (for example in step 76 of FIG. 6), and the indicium printed on the mail piece (step 78 of FIG. 6).

By reducing the actual processing time necessary to compute the complete signature for each mail piece by pre-computing and storing part of the digital signature, cryptographic processing for a current mail piece will be completed before the printing of the immediately previous mail piece has been completed. Thus, as soon as a mail piece has been printed, the printing for the next mail piece can begin without any delay. Thus, there is no idle time during the printing process. Since any idle time has been removed in the timing according to the present invention, the throughput of the mailing machine can be increased.

While preferred embodiments of the invention have been described and illustrated above, it should be understood that these are exemplary of the invention and are not to be considered as limiting. Additions, deletions, substitutions, and other modifications can be made without departing from the spirit or scope of the present invention. Accordingly, the invention is not to be considered as limited by the foregoing description.

What is claimed is:

1. A method for a mailing machine to provide evidence of postage for mail pieces comprising:

setting a postage value;

generating a first indicium based on the postage value, the first indicium being generated without accounting for the first indicium in the mailing machine;

storing the first indicium in a buffer;

continuously generating a plurality of subsequent indicia in immediate succession without accounting for the plurality of subsequent indicia in the mailing machine and storing the plurality of subsequent indicia in the buffer until the buffer is full or a new postage value is set;

determining if a mail piece is present in the mailing machine;

if a mail piece is present, retrieving one of the indicium from the buffer;

accounting for the indicium in at least one register in the mailing machine when the indicium is retrieved from the buffer; and using the indicium to provide evidence of postage for the mail piece.

2. The method of claim 1, wherein each of the indicium includes a digital signature.

3. The method of claim 1, wherein each of the indicium includes a value from the at least one register.

4. The method of claim 3, wherein the at least one register includes an ascending register and a descending register.

5. The method of claim 4, wherein the at least one register further includes a piece count register.

6. The method of claim 4, wherein generating a plurality of subsequent indicia further comprises:

generating a plurality of subsequent indicia based on what values of the ascending and descending registers would be if previous indicia had been accounted for.

7. The method of claim 1, wherein if a new postage value is set, the method further comprises:

erasing all indicia stored in the buffer.

8. The method of claim 1, wherein the buffer is a first-in, first-out buffer.

9. The method of claim 1, wherein setting a postage value further comprises:

receiving the postage value from an operator.

10. The method of claim 1, wherein setting a postage value further comprises:

setting the postage value based on a weight of the mail piece.

11. The method of claim 1, wherein each of the indicium includes an image, and using the indicium to evidence postage further comprises:

printing the image on the mail piece.

12. The method of claim 1, wherein using the indicium to provide evidence postage further comprises:

generating an image; and printing the image on the mail piece.

13. The method of claim 12, wherein generating an image further comprises:

combining the indicium with other information to generate the image.

14. A method for a mailing machine to provide evidence of postage for mail pieces comprising:

generating indicium data including a partial computation of a digital signature required to create an indicium that provides evidence of postage, the indicium data being generated without accounting for the indicium data in the mailing machine;

storing the indicium data in a buffer;

generating additional indicium data including a partial computation of a digital signature required to create an indicium that provides evidence of postage for a plurality of subsequent indicia in immediate succession without accounting for the indicium data for the plurality of subsequent indicia in the mailing machine and storing the indicium data for the plurality of subsequent indicia in the buffer;

determining if a mail piece is present in the mailing machine;

if a mail piece is present, retrieving one of the indicium data from the buffer;

setting a postage value for the mail piece;

accounting for the postage value from at least one register in the mailing machine for the indicium data retrieved from the buffer when the indicium data is retrieved from the buffer;

computing the digital signature using the indicium data and the postage value; and providing the digital signature as part of an indicium that provides evidence of postage for the mail piece.

15. The method of claim 14, wherein generating an indicium data further comprises:

generating an indicium data before processing of the mail pieces begins.

16. A security device for providing indicia for use in evidencing postage, the security device comprising:

at least one register;

a buffer; and a processor to generate the indicia coupled to the buffer and the at least one register, the processor generating a first indicium based on a postage value, the first indicium being generated without accounting for the first indicium in the security device, and storing the first indicium in the buffer, the processor continuously generating in immediate succession a plurality of subsequent indicia until the buffer is full or a new postage value is set, the plurality of subsequent indicia being generated without accounting for the plurality of subsequent indicia in the security device, the processor, upon request to provide one of the indicium, retrieving one of the indicium previously stored in the buffer for use in evidencing postage on a mail piece and accounting for the postage value from the at least one register for the indicium when the indicium is retrieved from the buffer.

17. The security device of claim 16, wherein each of the indicium includes a digital signature.

18. The security device of claim 16, wherein each of the indicium includes a value from the at least one register.

19. The security device of claim 18, wherein the at least one register includes an ascending register and a descending register.

20. The security device of claim 19, wherein the at least one register further includes a piece count register.

21. The security device of claim 19, wherein the processor generates the plurality of subsequent indicia data based on what values of the ascending and descending registers would be if previous indicia had been accounted for.

22. The security device of claim 16, wherein if a new postage value is set, the processor erases all indicia stored in the buffer.

23. The security device of claim 16, wherein the buffer is a first-in, first-out buffer.

24. A mailing machine comprising:

a printer for printing an indicium on a mail piece;

a controller coupled to the printer;

a buffer; and a security device coupled to the controller, the security device including at least one register and a processor coupled to the at least one register, the processor generating a first indicium based on a postage value without accounting for the first indicium in the mailing machine and storing the first indicium in the buffer, the processor continuously generating in immediate succession a plurality of subsequent indicia until the buffer is full or a new postage value is set, the plurality of subsequent indicia being generated without accounting for the plurality of subsequent indicia in the mailing machine, the processor, upon request to provide one of the indicium, retrieving one of the indicium previously stored in the buffer and accounting for the postage value from the at least one register for the indicium when the indicium is retrieved from the buffer, wherein the indicium is used to provide evidence of postage that is printed on the mail piece by the printer.

25. The mailing machine of claim 24, wherein each of the indicium includes a digital signature.

26. The mailing machine of claim 24, wherein each of the indicium includes a value from the at least one register.

27. The mailing machine of claim 26, wherein the at least one register includes an ascending register and a descending register.

28. The mailing machine of claim 27, wherein the at least one register further includes a piece count register.

29. The mailing machine of claim 27, wherein the processor generates the plurality of subsequent indicia based on what values of the ascending and descending registers would be if previous indicia had been accounted for.

30. The mailing machine of claim 24, wherein if a new postage value is set, the processor erases all indicia stored in the buffer.

31. The mailing machine of claim 24, wherein the buffer is a first-in, first-out buffer.

32. The mailing machine of claim 24, wherein the buffer is integral with the security device.

33. A mailing machine comprising:

a printer for printing an indicium on a mail piece;

a controller coupled to the printer;

a buffer; and a security device coupled to the controller, the security device including a processor, the processor generating indicium data without accounting for the indicium in the mailing machine and storing the indicium data in the buffer, the indicium data including a partial computation of a digital signature required to create an indicium, the processor generating in immediate succession additional indicium data for a plurality of subsequent indicia and storing the additional indicium data in the buffer until the buffer is full, the additional indicium data being generated without accounting for the indicium data, the processor, upon request to provide one of the indicium data, retrieving one of the indicium data previously stored in the buffer, accounting for the indicium data when the indicium data is retrieved from the buffer, and computing a full digital signature using the indicium data, wherein the full digital signature is used as part of the indicium for printing on a mail piece by the printer.

34. The mailing machine of claim 33, wherein the processor generates indicium data before processing of the mail pieces begins.

* * * * *